US007287955B2

(12) United States Patent
Amiot et al.

(10) Patent No.: US 7,287,955 B2
(45) Date of Patent: Oct. 30, 2007

(54) GAS TURBINE CLEARANCE CONTROL DEVICES

(75) Inventors: Denis Amiot, Dammarie les Lys (FR); Anne-Marie Arraitz, Nandy (FR); Thierry Fachat, Moissy Cramayel (FR); Alain Gendraud, Vernou la Celle sur Seine (FR); Pascal Lefebvre, Vulaines sur Seine (FR); Delphine Roussin-Moynier, Antony (FR)

(73) Assignee: Snecma Moteurs, Paris (FR)

( * ) Notice: Subject to any disclaimer, the term of this patent is extended or adjusted under 35 U.S.C. 154(b) by 350 days.

(21) Appl. No.: 11/031,128

(22) Filed: Jan. 10, 2005

(65) Prior Publication Data

US 2005/0158169 A1 Jul. 21, 2005

(30) Foreign Application Priority Data

Jan. 16, 2004 (FR) ..... 04 00393

(51) Int. Cl.
*F01D 11/18* (2006.01)

(52) U.S. Cl. ..... 415/173.2

(58) Field of Classification Search ..... 415/171.1, 415/173.1, 173.2

See application file for complete search history.

(56) References Cited

U.S. PATENT DOCUMENTS 5,205,115 A * 4/1993 Plemmons et al. ..... 60/806
6,035,929 A * 3/2000 Friedel et al. ..... 165/168
2002/0053837 A1 5/2002 Arilla et al.

FOREIGN PATENT DOCUMENTS

EP 0 541 325 A1 5/2003
FR 2 629 517 10/1989

* cited by examiner

*Primary Examiner*—Edward K. Look
*Assistant Examiner*—Devin Hanan
(74) *Attorney, Agent, or Firm*—Oblon, Spivak, McClelland, Maier & Neustadt, P.C.

(57) ABSTRACT

A clearance control device for controlling clearance between rotary blade tips and a stationary bushing of a gas turbine having a casing that is provided with at least two annular ridges, the clearance control device including a circular tuning unit that includes air circulation means for circulating air, said means being made up of at least three ducts; air supply means for supplying air to the air flow ducts; and air discharge means for discharging air on the ridges in order to modify the temperature, the air discharge means for each duct being made up of at least one top row having a number N of perforations disposed facing one of the side faces of the ridges and of at least one bottom row having a number 2N of perforations disposed facing a connection radius that connects the ridges to the casing.

19 Claims, 2 Drawing Sheets

GAS TURBINE CLEARANCE CONTROL DEVICES

BACKGROUND OF THE INVENTION

The present invention relates to the general field of controlling clearance between the tips of rotor blades and a stationary bushing in a gas turbine.

By way of example, a gas turbine typically includes a plurality of stator blades disposed in alternation with a plurality of rotor blades in a passage for hot gases coming from a combustion chamber of the turbomachine. Over the entire circumference of the turbine, the rotor blades of the turbine are surrounded by a stationary bushing. Said stationary bushing defines a wall for the stream of hot gases passing through the turbine blades.

In order to increase the efficiency of the turbine, it is known to reduce the clearance that exists between the tips of the rotor blades of the turbine and the portions of the stationary bushing that face said blades to as little as possible.

To do this, means have been devised for varying the diameter of the stationary bushing. Generally, said means come in the form of annular pipes which surround the stationary bushing, and through which air is passed that is drawn from other portions of the turbomachine. The air is injected over the outer surface of the stationary bushing, causing the stationary bushing to expand or contract thermally, thereby changing its diameter. Depending on the operating speed of the turbine, the thermal expansions and contractions are controlled by a valve which serves to control both the flow rate and the temperature of the air fed to the pipes. Thus, the assembly consisting of the pipes together with the valve constitutes a tuning unit for tuning clearance at the blade tips.

Existing tuning units do not always make it possible to obtain highly uniform temperature over the entire circumference of the stationary bushing. A lack of temperature uniformity leads to distortions in the stationary bushing, which are particularly detrimental to the efficiency and the lifetime of the gas turbine.

Moreover, in existing tuning units, injection of air over the outer surface of the stationary bushing is generally not optimized, so that it is often necessary to draw a considerable amount of air in order to cool the stationary bushing. If too much air is drawn, this impairs the efficiency of the turbomachine.

OBJECTS AND SUMMARY OF THE INVENTION

Therefore, the present invention aims at mitigating such drawbacks by providing a clearance control device which makes it possible to optimize air injection in order to cool the stationary bushing more effectively and more uniformly.

To this end, the invention provides a clearance control device for controlling clearance between rotary blade tips and a stationary bushing of a gas turbine, said stationary bushing including an annular casing that has a longitudinal axis and that is provided with at least two annular ridges axially spaced apart from each other and extending radially outwards of said casing, the clearance control device including a circular tuning unit that surrounds the casing of the stationary bushing, said tuning unit including: air circulation means for circulating air, said means being made up of at least three annular ducts axially spaced apart one from another and being disposed on either side of side faces of each of the ridges; air supply means for supplying air to the air flow ducts; and air discharge means for discharging air on the ridges in order to modify the temperature of the stationary bushing, wherein, for each air flow duct, the air discharge means are made up of at least one top row having a number N of perforations disposed facing one of the side faces of the ridges and of at least one bottom row having a number 2N of perforations disposed facing a connection radius that connects the ridges to the casing of the stationary bushing.

The distribution and the positioning of the air discharge perforations make it possible to optimize the heat exchange coefficient between the ridges and the air flowing through said ridges. Thereby, greater effectiveness is obtained, and the ridges are cooled more uniformly, so that the casing has a wider range of movement for tuning clearance at the turbine blade tips.

When the ridges consist of an upstream ridge and of a downstream ridge and the ducts consist of an upstream duct disposed upstream from the upstream ridge, of a downstream duct disposed downstream from the downstream ridge, and of a central duct disposed between the upstream ridge and the downstream ridge, preferably the central duct has at least two top rows each having N perforations disposed facing the side faces of the upstream ridge and of the downstream ridge, and at least two bottom rows each having 2N perforations disposed facing connection radii that connect the upstream wing and the downstream wing to the casing of the stationary bushing.

According to an advantageous characteristic of the invention, the upstream duct and the downstream duct each have substantially identical air outflow sections, and the central duct has an air outflow section that is substantially twice as large as the air outflow section of said upstream duct and of said downstream duct.

According to another advantageous characteristic of the invention, the N perforations in each top row and the 2N perforations in each bottom row have substantially identical air outflow sections.

According to a further advantageous characteristic of the invention, the N perforations in each top row and the 2N perforations in each bottom row are disposed in a zigzag configuration.

BRIEF DESCRIPTION OF THE DRAWINGS

Other characteristics and advantages of the present invention appear in the description below, given with reference to the accompanying drawings which show a non-limiting embodiment of the invention. In the figures.

DETAILED DESCRIPTION OF AN EMBODIMENT

Figure 1:
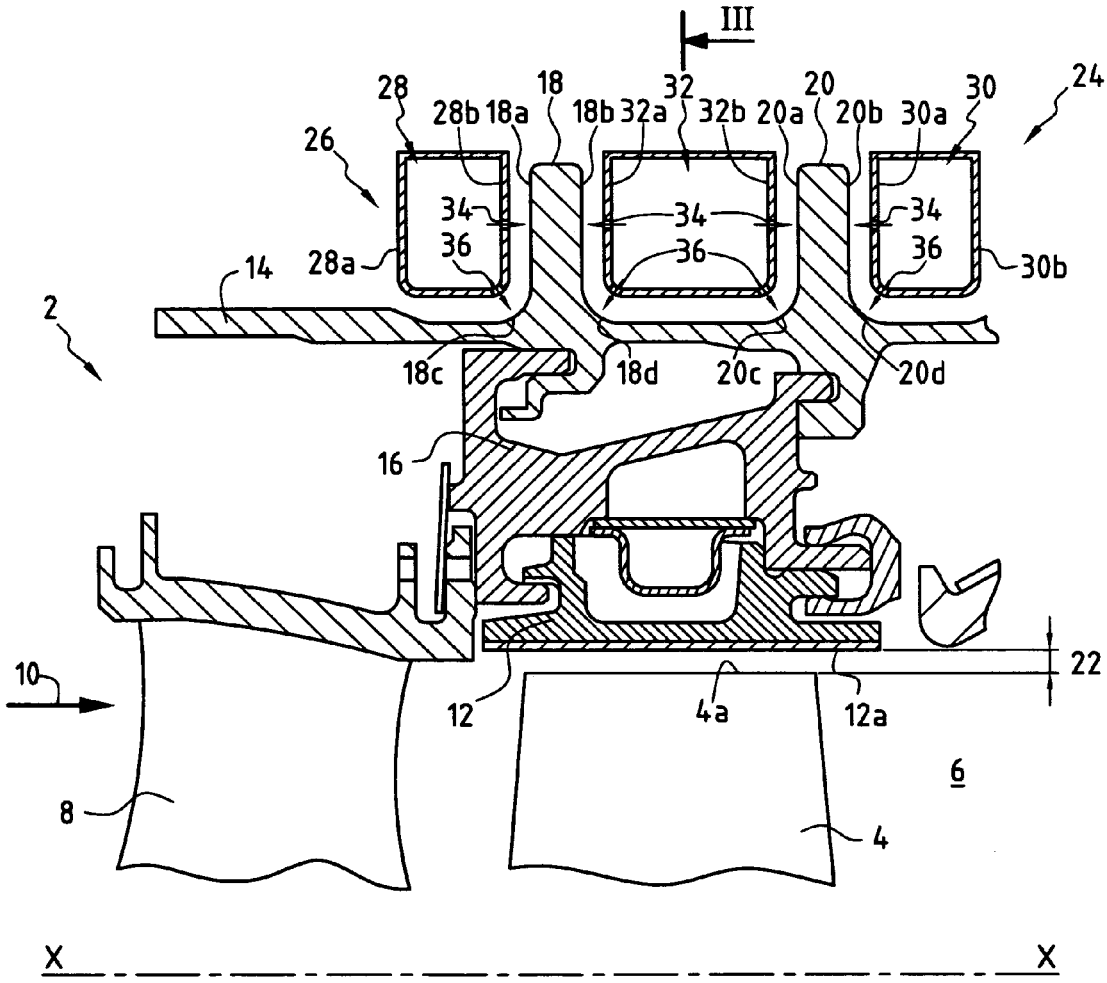
FIG. 1 is a longitudinal section view of a clearance control device in accordance with the invention.

FIG. 1 is a longitudinal section which shows a high pressure turbine 2 of a turbomachine of longitudinal axis X-X. Nevertheless, the present invention could equally well be applied to a low-pressure turbine of a turbomachine or to any other gas turbine that is fitted with a device for controlling clearance at its blade tips.

The high-pressure turbine 2 consists, in particular, of a plurality of rotor blades 4 disposed in a stream 6 of hot gases that come from a combustion chamber (not shown) of the turbomachine. Said rotor blades 4 are disposed downstream from the stator blades 8 relative to the direction 10 in which the hot gases flow in the stream 6.

The rotor blades 4 of the high pressure turbine 2 are surrounded by a plurality of bushing segments 12 that are disposed circumferentially about the axis X-X of the turbine so as to form a circular and continuous surface. The bushing segments 12 are assembled via a plurality of spacers 16 on an annular casing 14, likewise of longitudinal axis X-X.

Throughout the description below, the assembly consisting of the bushing segments 12, of the casing 14, and of the spacers 16 is referred to as a "stationary bushing".

The casing 14 of the stationary bushing is provided with at least two annular ridges or annular projections 18, 20 that are axially spaced apart from each other and that extend radially outwards from the casing 14. Said ridges are distinguished relative to the direction 10 in which the hot gases flow in the stream 6, being referred to as the "upstream" ridge 18 and the "downstream" ridge 20. The main function of the upstream and the downstream ridges 18, 20 is to serve as heat exchangers.

Each of the bushing segments 12 has an inner surface 12*a* that is in direct contact with the hot gas, said inner surface defining a portion of the gas stream 6 that passes through the high-pressure turbine 2.

Radial clearance 22 is left between the inner surfaces 12*a* of the bushing segments 12 and the tips of the rotor blades 4 of the high-pressure turbine 2 so as to allow the rotor blades to rotate. In order to increase turbine efficiency, said clearance 22 must be as small as possible.

In order to reduce the clearance 22 at the tips 4*a* of the rotor blades 4, a clearance control device 24 is provided. The clearance control device 24 comprises, in particular, a circular tuning unit 26 that surrounds the stationary bushing, and more specifically the casing 14.

Depending on the operating speed of the turbomachine, the tuning unit 26 is designed to cool or to heat the upstream ridge 18 of the casing 14 and the downstream ridge 20 of the casing 14 by discharging (or striking) air onto said ridges. Under the effect of this discharge of air, the casing 14 contracts or expands, which reduces or increases the diameter of the stationary bushing segments 12 of the turbine, thereby adjusting the clearance 22 at the blade tips.

In particular, the tuning unit 26 includes at least three annular air flow ducts 28, 30 and 32 that surround the casing 14 of the stationary bushing. Said ducts are axially spaced apart from one another, and they are also substantially parallel to one another. They are disposed on either side of side faces of each of the ridges 18, 20, and fit their shape approximately.

The air flow ducts 28, 30 and 32 consist of an upstream duct 28 that is disposed upstream from the upstream ridge 18 (relative to the direction 10 in which the hot gases flow in the stream 6), of a downstream duct 30 that is disposed downstream from the downstream ridge 20, and of a central duct that is disposed between the upstream ridge 18 and between the downstream ridge 20.

The tuning unit 26 also includes a tubular air manifold (not shown in the figures) for supplying the air flow ducts 28, 30 and 32 with air. Said air manifold surrounds the ducts 28, 30 and 32 and supplies them with air via air pipes (not shown in the figures).

According to the invention, each air flow duct 28, 30 and 32 of the tuning unit has at least one top row having N perforations disposed facing one of the side faces of the ridges 18, 20 and at least one bottom row having 2N perforations 36 disposed facing a connection radius that connects the ridges 18, 20 to the casing 14 of the stationary bushing The perforations 34, 36 are obtained by laser, for example, and they enable the air flowing in the ducts 28, 30 and 32 to be discharged onto the ridges 18, 20 so as to modify their temperature.

Figure 2:
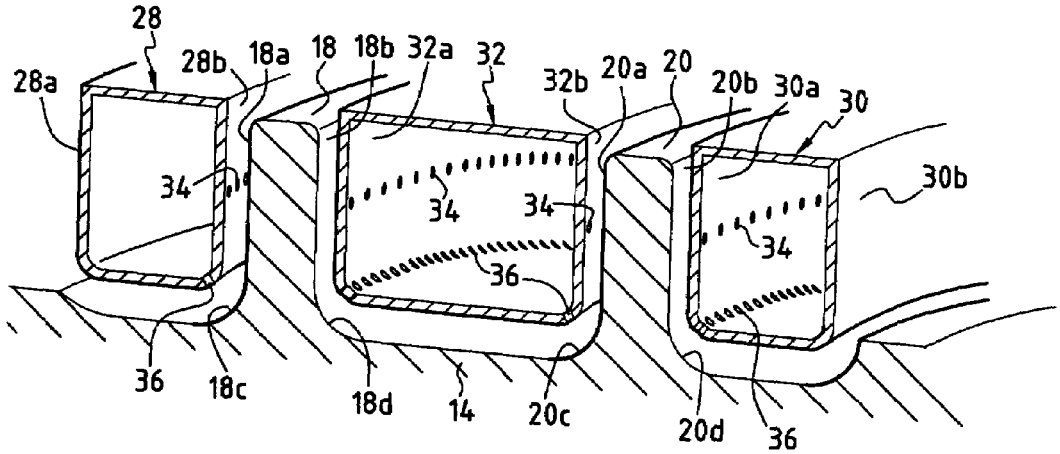
FIG. 2 is a fragmentary view in perspective of the air flow ducts of the clearance control device of FIG. 1.

As shown in FIGS. 1 and 2, the upstream duct 28 includes at least one top row having N perforations 34 on the side of its downstream wall 28*b*, said top row of perforations being disposed facing the upstream side face 18*a* of the upstream ridge 18, and at least one bottom row of 2N perforations 36 being disposed facing a connection radius 18*c* that connects the upstream ridge 18 to the casing 14 of the stationary bushing. There are no perforations in the upstream wall 28*a* of the upstream duct 28.

Likewise, the downstream duct 30 includes at least one top row of N perforations 34 on the side of its upstream wall 30*a*, said top row of perforations being disposed facing the downstream side face 20*b* of the downstream ridge 20, and at least one bottom row of 2N perforations 36 being disposed facing a connection radius 20*d* that connects the downstream ridge 20 to the casing 14 of the stationary bushing. There are no perforations in the downstream wall 30*b* of the downstream duct 30.

Preferably, the central duct 32 includes at least two top rows, each having N perforations 34 disposed facing the side faces 18*b*, 20*a* of the upstream ridge 18 and of the downstream ridge 20, and at least two bottom rows each having 2N perforations 36 disposed facing the connection radii 18*d*, 20*c* that connect the upstream ridge 18 and the downstream ridge 20 to the carter 14 of the stationary bushing.

In fact, in its upstream wall 32*a* the central duct 32 has at least one top row of N perforations 34 disposed facing the downstream side face 18*b* of the upstream ridge 18 and at least one bottom row of 2N perforations disposed facing a connection radius 18*d* that connects the upstream ridge 18 to the casing 14 of the stationary bushing.

In its downstream wall 32*b*, the central duct 32 has at least one top row of N perforations 34 disposed facing the upstream side face 18*b* of the downstream ridge 20 and at least one bottom row of 2N perforations 36 disposed facing a connection radius 20*c* that connects the downstream ridge 20 to the casing 14 of the stationary bushing.

In other words, the air discharge perforations 34, 36 in each air flow duct 28, 30 and 32 of the tuning unit 26 are disposed in two rows, with two thirds of the perforations in the bottom row and with the remaining third in the top row. The air coming through the 2N perforations 36 in each bottom row "strikes" a bottom zone of the ridges 18, 20 whereas the air discharged by the N perforations 34 in each top row strikes a middle zone of the ridges.

Thus, the heat exchange on the ridges is uniform, thereby giving the casing a wider range of movement so that said casing tunes clearance at the turbine blade tips. Calculations carried out on thermal influences show that with a two-row configuration, there is an improvement of up to 50° C. in the average temperature of a ridge, compared with a single row configuration of perforations.

According to an advantageous characteristic of the invention, the upstream duct 28 and the downstream duct 30 each has a substantially identical air outflow section, and the central duct 32 has an air outflow section that is twice as large as the air outflow section of said upstream duct 28 and of said downstream duct 30 together. In fact, since the central duct 32 is advantageously perforated on both sides, there must be twice the amount of air flowing in the central duct as there is flowing in each of the upstream duct 28 and the downstream duct 30.

According to another advantageous characteristic of the invention, the N perforations 34 in each top row and the 2N perforations 36 in each bottom row have substantially identical air outflow sections for each of the air flow ducts 28, 30 and 32.

In this manner, one third of the air flow flowing in the central duct 32 is discharged via each of the two bottom rows of perforations 36 and one sixth of the same air is evacuated via each of the two top rows of perforations 34. Likewise, two thirds of the air flowing in the upstream duct 28 or in the downstream duct 30 is discharged via the bottom rows of perforations 36 of said ducts and one third of the same air flow is evacuated via the top rows of perforations 34 of said ducts.

Figure 3:
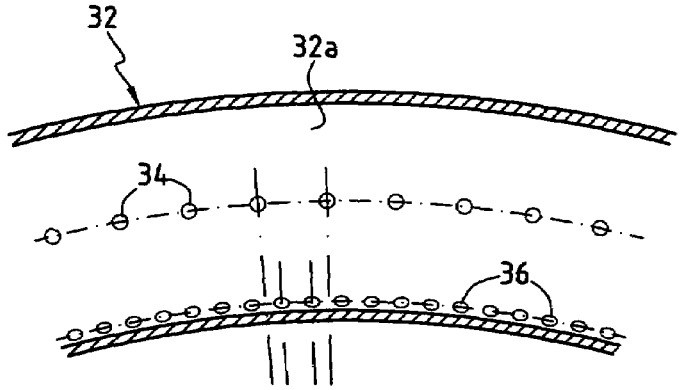
FIG. 3 is a section view on line III-III of FIG. 1.

According to another advantageous characteristic of the invention shown in FIG. 3, in each air flow duct, the N perforations 34 in each top row and the 2N perforations 36 in each bottom row are disposed in a zigzag configuration.

Moreover, for each air flow duct 28, 30 and 32, the perforations 34 in each top row and the perforations 36 in each bottom row are preferably regularly spaced apart around the longitudinal axis X-X of the casing 14 of the stationary bushing.

When each of the perforations 34 in the top row and each of the perforations 36 in the bottom row presents a substantially circular right section, the angular space between two adjacent perforations 34 of a same top row advantageously corresponds to at least three times the diameter of said perforations.

The number and the diameter selected for the air discharge perforations 34, 36 may be optimized by computer simulation based on making a compromise between effective ventilation of the ridges and constraints relating to manufacturing the tuning unit. By way of example, for ridges with a radial height of 18 millimeters (mm), 288 perforations could be made in each top row, and 576 perforations in each bottom row (which gives N a value of 288). In such a configuration, the diameter of each perforation may be fixed at 1 mm and the space between two adjacent perforations in a top row may be 3.8 mm (which corresponds to 3.8 times the diameter of the perforations).

What is claimed is:

1. A clearance control device for controlling clearance between rotary blade tips and a stationary bushing of a gas turbine, said stationary bushing including an annular casing that has a longitudinal axis and that is provided with at least two annular ridges axially spaced apart from each other and extending radially outwards of said casing, said clearance control device including a circular tuning unit that surrounds the casing of the stationary bushing, said tuning unit including:

an air circulation device configured to circulate air, said air circulation device including at least three annular air flow ducts axially spaced apart one from another and disposed on either side of side faces of each of the ridges;

an air supply device configured to supply air to the air flow ducts; and an air discharge mechanism configured to discharge air on the ridges in order to modify the temperature of the stationary bushing;

wherein, for each air flow duct, the air discharge mechanism includes at least one top row having a number N of perforations disposed facing one of the side faces of the ridges and at least one bottom row having a number 2N of perforations aligned with each other on said bottom row along a perimeter of said air flow duct and disposed facing a connection radius that connects the ridges to the casing of the stationary bushing.

2. A device according to claim 1, in which the ridges include an upstream ridge and a downstream ridge and the ducts include an upstream duct disposed upstream from the upstream ridge, a downstream duct disposed downstream from the downstream ridge, and a central duct disposed between the upstream ridge and the downstream ridge, wherein the central duct has at least two top rows each having N perforations disposed facing the side faces of the upstream ridge and of the downstream ridge, and at least two bottom rows each having 2N perforations disposed facing connection radii that connect the upstream wing and the downstream wing to the casing of the stationary bushing.

3. A device according to claim 2, wherein the upstream duct and the downstream duct each has substantially identical air outflow section, and the central duct has an air outflow section that is substantially twice as large as the air outflow section of said upstream duct and of said downstream duct together.

4. A device according to claim 2, wherein said upstream and downstream ducts each have only one bottom row with said 2N perforations aligned with each other around the longitudinal axis of the casing, and wherein said central duct has only two top rows, each top row having no more than said N perforations, and wherein said central duct has only one bottom row with said 2N perforations aligned with each other around the longitudinal axis of the casing and facing an upstream connection radius that connects the upstream ridge to the casing of the stationary bushing, and only one bottom row with said 2N perforations aligned with each other around the longitudinal axis of the casing and facing a downstream connection radius that connects the downstream ridge to the casing of the stationary bushing.

5. A device according to claim 1, wherein the N perforations in each top row and the 2N perforations in each bottom row have substantially identical air outflow sections.

6. A device according to claim 1, wherein the N perforations in each top row and the 2N perforations in each bottom row are regularly spaced apart around the longitudinal axis of the casing of the stationary bushing.

7. A device according to claim 1, in which each of the perforations in the top row and each of the perforations in the bottom row presents a substantially circular right section, wherein the angular space between two adjacent perforations of a same top row corresponds to at least three times the diameter of said perforations.

8. A device according to claim 1, wherein the air flow ducts fit the shape of the ridges approximately.

9. A device according to claim 1, wherein for at least one of said air flow ducts, said top row includes no more than said N perforations and said air discharge mechanism includes only one bottom row with said 2N perforations aligned with each other around the longitudinal axis of the casing.

10. A device according to claim 9, wherein said 2N perforations of said at least one bottom row do not face said side faces of the ridges that said N perforations of said at least one top row face.

11. A device according to claim 1, wherein said 2N perforations of said at least one bottom row do not face said side faces of the ridges that said N perforations of said at least one top row face.

12. A turbomachine having a clearance control device according to claim 1.

13. A device according to claim 1, wherein the air flow ducts fit the shape of the ridges approximately.

14. A clearance control device for controlling clearance between rotary blade tips and a stationary bushing of a gas turbine, said stationary bushing including an annular casing that has a longitudinal axis and that is provided with at least two annular ridges axially spaced apart from each other and extending radially outwards of said casing, said clearance control device including a circular tuning unit that surrounds the casing of the stationary bushing, said tuning unit including:

an air circulation device configured to circulate air, said air circulation device including at least three annular air flow ducts axially spaced apart one from another and disposed on either side of side faces of each of the ridges;

an air supply device configured to supply air to the air flow ducts; and an air discharge mechanism configured to discharge air on the ridges in order to modify the temperature of the stationary bushing;

wherein, for each air flow duct, the air discharge mechanism includes at least one top row having a number N of perforations disposed facing one of the side faces of the ridges and at least one bottom row having a number 2N of perforations disposed facing a connection radius that connects the ridges to the casing of the stationary bushing, and wherein the N perforations in each top row are staggered with respect to the 2N perforations in each bottom row.

15. A clearance control device for controlling clearance between rotary blade tips and a stationary bushing of a gas turbine, said stationary bushing including an annular casing that has a longitudinal axis and that is provided with at least one upstream ridge and one downstream ridge extending radially outwards of said casing, said clearance control device including a circular tuning unit that surrounds the casing of the stationary bushing, said tuning unit including:

an upstream air flow duct positioned upstream from said upstream ridge, a central air flow duct positioned between said upstream ridge and said downstream ridge, and a downstream air flow duct position downstream of said downstream ridge, wherein said upstream air duct has 3N perforations distributed over only two rows, with a top row being defined by N perforations and a bottom row being defined by 2N perforations, said N perforations of said top row facing said upstream ridge and said 2N perforations of said bottom row facing a connection radius that connects the upstream ridge to the casing, wherein said central air duct has 6N perforations distributed over only four rows, with an upstream top row defined by N perforations, a downstream top row defined by N perforations, an upstream bottom row defined by 2N perforations, and a downstream bottom row defined by 2N perforations, said N perforations of said upstream top row facing said upstream ridge, said N perforations of said downstream top row facing said downstream ridge, said 2N perforations of said upstream bottom row facing said connection radius that connects the upstream ridge to the casing, and said 2N perforations of said downstream bottom row facing a connection radius that connects the downstream ridge to the casing, wherein said downstream air duct has 3N perforations distributed over only two rows, with a top row being defined by N perforations and a bottom row being defined by 2N perforations, said N perforations of said top row facing said downstream ridge and said 2N perforations of said bottom row facing said connection radius that connects the downstream ridge to the casing.

16. A device according to claim 15, wherein the upstream air duct and the downstream air duct each has substantially identical air outflow section, and the central air duct has an air outflow section that is substantially twice as large as the air outflow section of said upstream duct and of said downstream duct together.

17. A device according to claim 15, wherein the N perforations in each top row and the 2N perforations in each bottom row have substantially identical air outflow sections.

18. A device according to claim 15, wherein the N perforations in each top row and the 2N perforations in each bottom row are regularly spaced apart around the longitudinal axis of the casing of the stationary bushing.

19. A device according to claim 15, wherein each of the perforations in the top rows and each of the perforations in the bottom rows presents a substantially circular right section, wherein the angular space between two adjacent perforations of a same top row corresponds to at least three times the diameter of said perforations.

* * * * *